US006581416B2

(12) United States Patent
Sangiacomo

(10) Patent No.: US 6,581,416 B2
(45) Date of Patent: Jun. 24, 2003

(54) DOUBLE CYLINDER CIRCULAR KNITTING MACHINES

(75) Inventor: Fulvio Sangiacomo, Brescia (IT)

(73) Assignee: Sangiacomo S.p.A. (IT)

( * ) Notice: Subject to any disclaimer, the term of this patent is extended or adjusted under 35 U.S.C. 154(b) by 0 days.

(21) Appl. No.: 10/295,057

(22) Filed: Nov. 14, 2002

(65) Prior Publication Data

US 2003/0094018 A1 May 22, 2003

(30) Foreign Application Priority Data

Nov. 21, 2001 (IT) ..... BS2001A0093

(51) Int. Cl.[7] ..... D04B 35/00
(52) U.S. Cl. ..... 66/14; 66/17; 66/145 S
(58) Field of Search ..... 66/17, 18, 8, 13, 66/14, 125 R, 145 R, 145 S, 146

(56) References Cited

U.S. PATENT DOCUMENTS 3,079,779 A * 3/1963 Butler et al. ..... 66/140 S
3,224,230 A * 12/1965 Dusik et al. ..... 66/145 R
3,760,608 A * 9/1973 Lonati ..... 66/140 S
4,887,440 A * 12/1989 Jelinek ..... 66/145 S
5,031,422 A * 7/1991 Plath ..... 66/145 S
6,073,466 A * 6/2000 Marchesi et al. ..... 66/145 S
6,209,361 B1 * 4/2001 Adams ..... 66/145 S

* cited by examiner

*Primary Examiner*—Danny Worrell
(74) *Attorney, Agent, or Firm*—McGlew & Tuttle, P.C.

(57) ABSTRACT

The invention relates to a double cylinder circular knitting machine which comprises at least one nozzle (18) providing a blast of air close to a yarn cutting-and-locking unit (13) to divert the ends of yarns cut and held by the said unit towards the interior of the cylinder, that is towards the reverse side of the item being manufactured. At the same time each cam (14, 21) for moving the needles where the yarns are picked up from the yarn guides is located and configured to move the needles at a predetermined distance from the yarn cutting-and-locking unit so as to leave a space for diverting the end (20) of the cut yarn towards the interior of the cylinder.

7 Claims, 6 Drawing Sheets

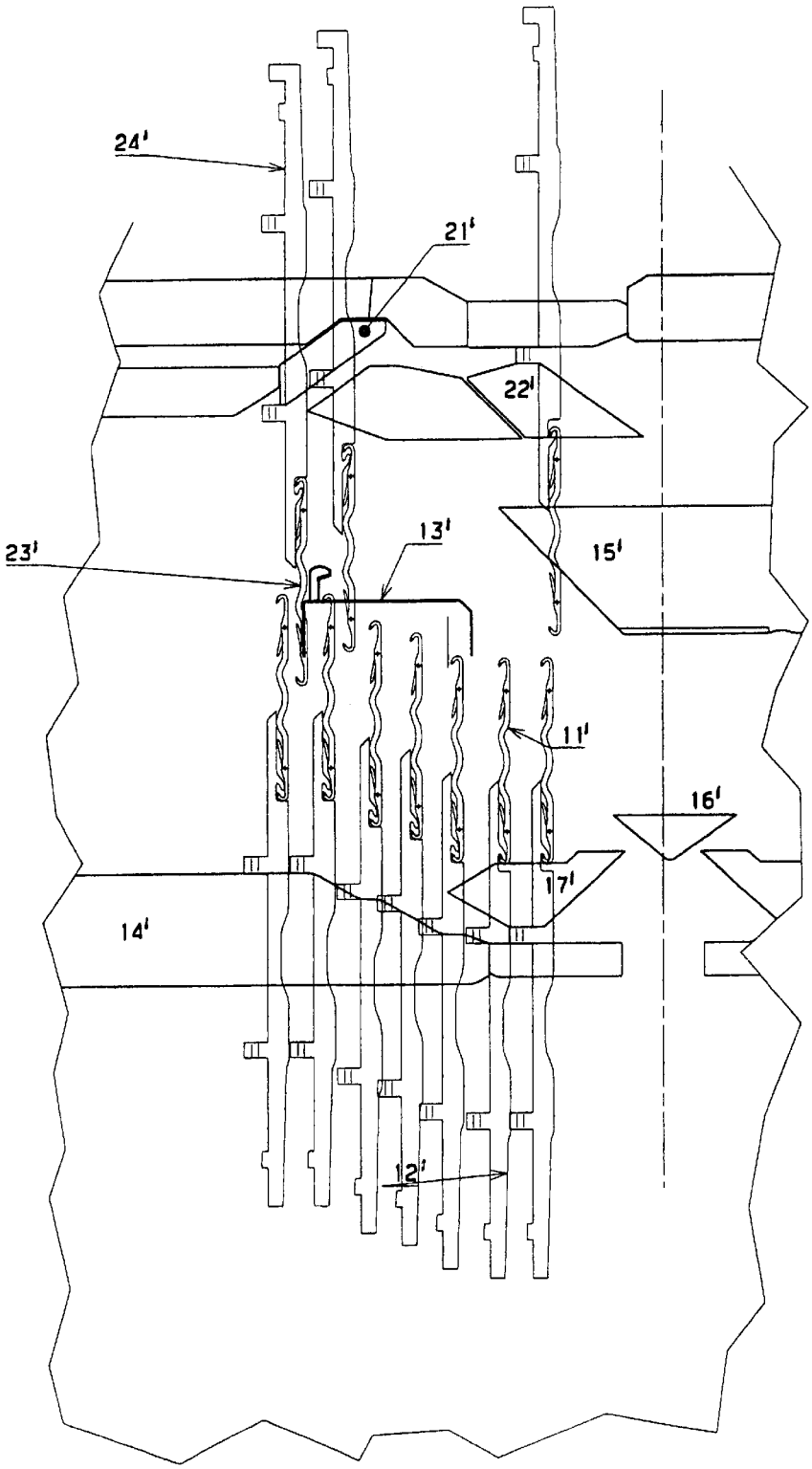
PRIOR ART
FIG. 1
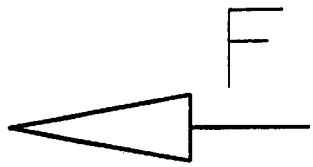

DOUBLE CYLINDER CIRCULAR KNITTING MACHINES

FIELD OF THE INVENTION

This invention relates to the field of circular knitting machines, and relates in particular to improvements to double cylinder circular knitting machines.

STATE OF THE ART

Double cylinder circular knitting machines and their operation are well known. They essentially comprise a lower cylinder part and an upper cylinder part which are coaxial and rotate together, a number of double hook needles placed in channels which coincide at the periphery of the two cylinder parts, sliders engaging the needles for selectively transferring these from one part of the cylinder to the other, cams to displace the sliders and, through these, to effect the operating movements of the needles and the yarn guides to feed the needles with each yarn which has to be knitted.

These double cylinder circular machines may have one or more feed stations and, with a suitable symmetrical arrangement of the cams at each feed station, can operate both with continuous rotary motion and alternating rotary motion according to the parts of an item which is being manufactured.

These machines are also normally equipped with scissors or with a yarn cutting-and-locking unit when a yarn has to be cut in the course of knitting and temporarily excluded from the work. The end of the cut yarn is then retained by the cutting-and-locking unit until the yarn is again taken up by the needles.

When knitting, the needles take the yarns from the corresponding yarn guides located at an intermediate level between the two lower and upper parts of the cylinder and perform rising and descending movements drawn by the corresponding sliders, which have to selectively follow working and resting courses determined by the corresponding control cams located around the double cylinder.

In particular, while knitting is in progress, the working needles at the point where the stitch is cast off are moved upwards by a lifting cam around the lower cylinder part (knit needles) and downwards by a cam around the upper cylinder part (purl needles). At the present time the said cams imparting movement, and therefore displacement of the needles to cast off the stitch, are substantially arranged corresponding to or in any event at a restricted distance from the yarn cutting-and-locking unit in a circumferential direction. This arrangement of the yarn cutting-and-locking units and the cams moving the needles through sliders according to the known art is illustrated for example in FIGS. 1, 3 and 4 of the drawings, in which arrow F indicates the direction of rotation of the double cylinder. Such needles 11' and 23' in the coruse of movement, sliders 12' and 24' connected to the said needles, yarn cutting-and-locking unit 13', moving cams 14' and 21', needle tongue-guard cam 15' and feed cam 16' in association with sinker cams 17' and 22' will especially be noted in FIG. 1. FIGS. 3 and 4 show the position of a yarn guide 19' in relation to needles 11' and yarn cutting-and-locking unit 13', were not working and when starting work respectively.

However, such a conventional arrangement of the parts of the machine may result in a disadvantage during knitting. In fact it can happen that when the yarn is subsequently picked up by the working needles the free end 20' of the cut and retained yarn projects externally from the manufactured surface, and is therefore visible, thus in an unaesthetic position, the elimination of which requires manual intervention and drawing the end of the yarn towards the reverse side of the manufactured article, an operation which is awkward and time-consuming.

SCOPE AND SUMMARY OF THE INVENTION

The purpose of this invention is to effectively overcome the disadvantage mentioned above, so that manufactured articles of better quality can be made on double cylinder circular machines without visible projecting pieces of yarn.

Another object of the invention is to eliminate the abovementioned disadvantage directly within the machine, by simple and efficient means which are capable of diverting the ends of the cut yarns in a more suitable direction so that they are hidden within the finished manufactured article.

The said objects and the advantages which derive therefrom are achieved in accordance with the invention by providing a double cylinder circular machine with a nozzle providing an air blast close to the yarn cutting-and-locking unit to divert the ends of the cut yarns held by the said unit towards the interior of the cylinder, that is onto the reverse side of the item being manufactured.

In order to create a space for physically fitting the nozzle in the vicinity of the yarn cutting-and-locking unit and to ensure that the air blast produced by the said nozzle is effective, the movement of the needles which have to cast off the stitch is delayed and displaced from this yarn cutting-and-locking unit in a circumferential direction. This is achieved by modification and repositioning of the cams moving the needles so that they are displaced a particular distance from the yarn cutting-and-locking unit as a result of the operation of these cams.

BRIEF DESCRIPTION OF THE DRAWINGS

Further details of the invention will be apparent from the description which is made with reference to the appended indicative and non-restrictive drawings in which:

FIG. 1 shows a view from the interior of the cylinder of a part of the double cylinder circular machine according to the abovementioned state of the art.

DETAILED DESCRIPTION OF THE INVENTION

Figure 2:
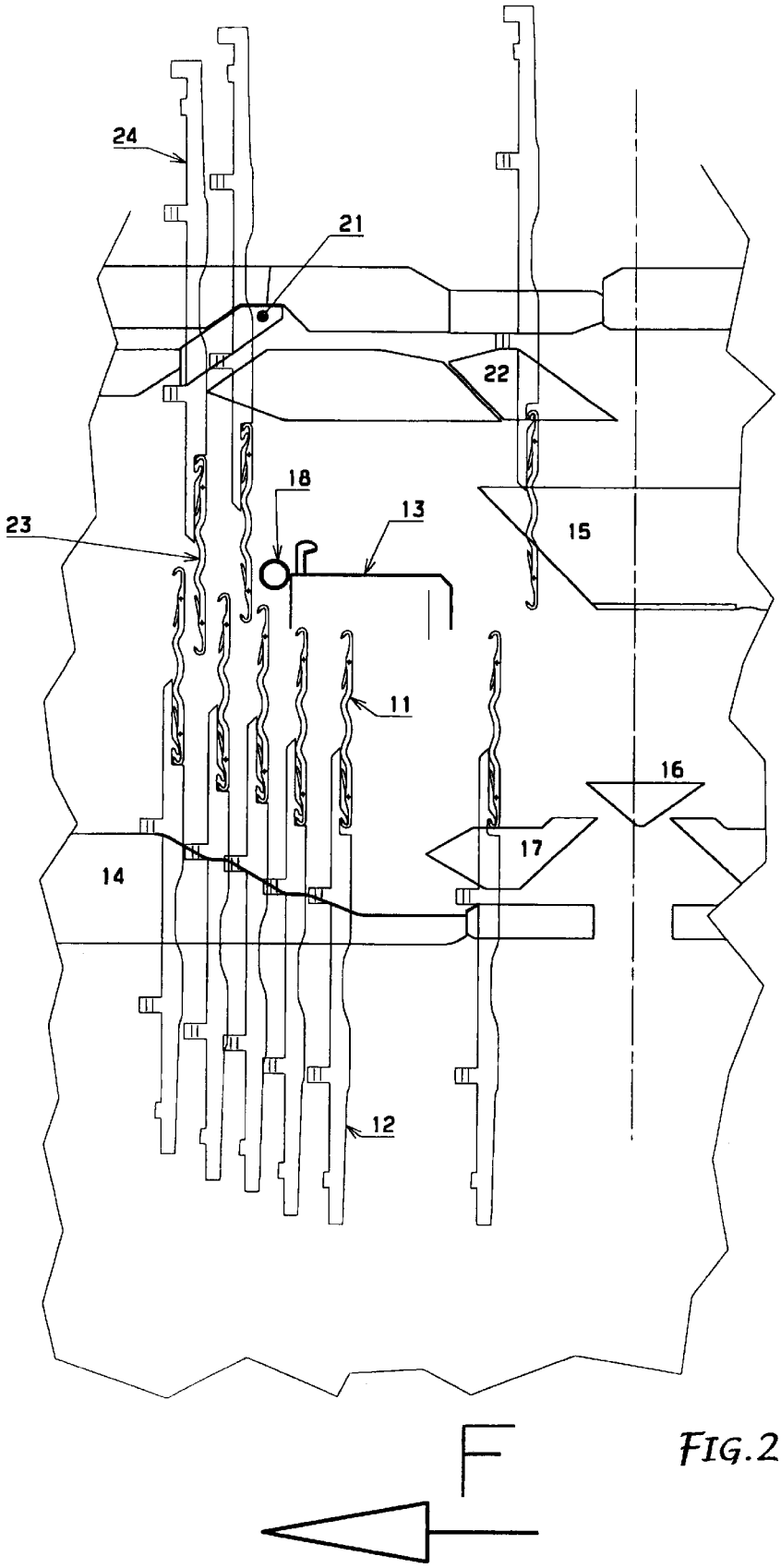
FIG. 2 shows a similar view of a double cylinder circular machine incorporating the invention.
Figure 3:
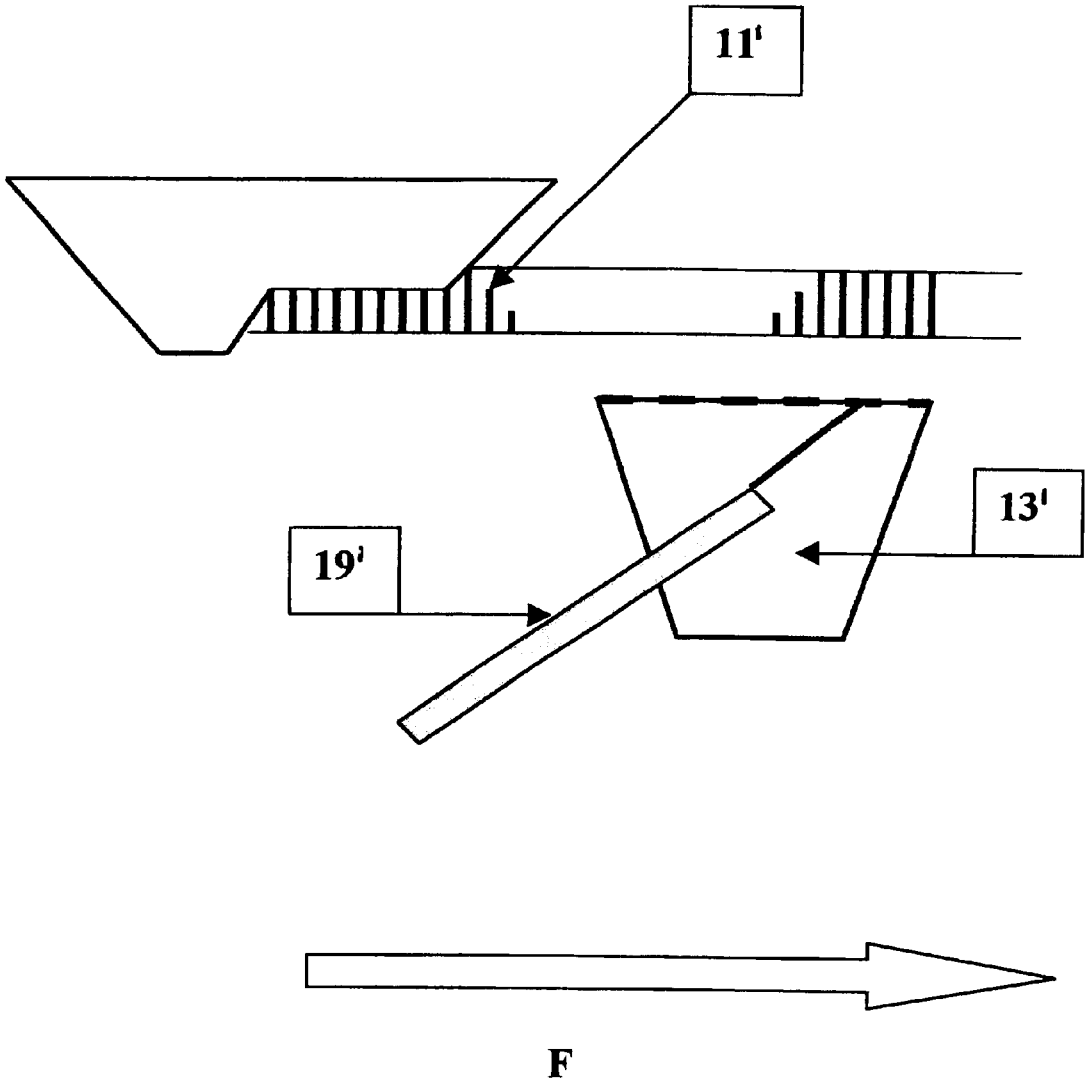
FIGS. 3 and 4 show two sequential positions of the needle and a yarn guide in relation to the yarn cutting-and-locking unit according to the state of the art.
Figure 4:
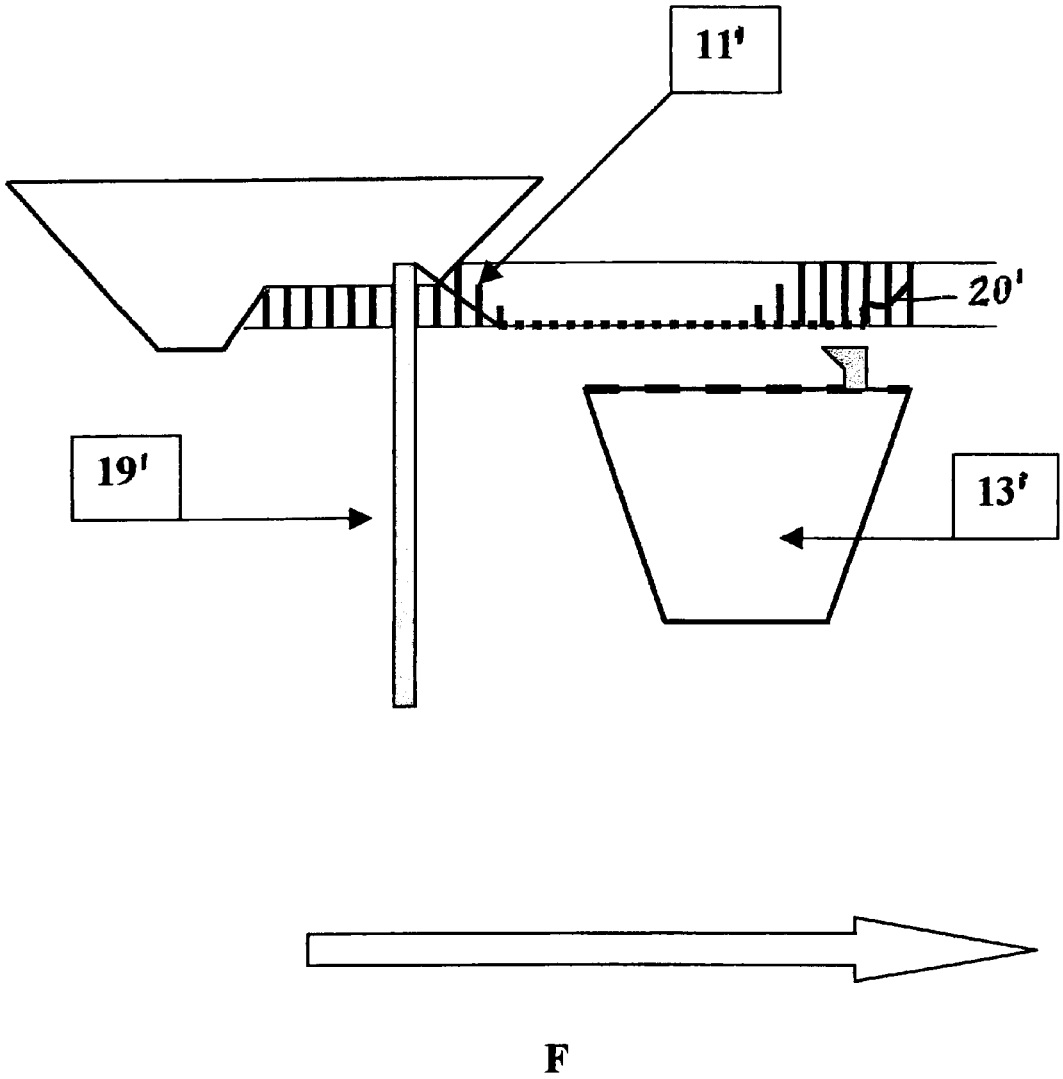
Figure 5:
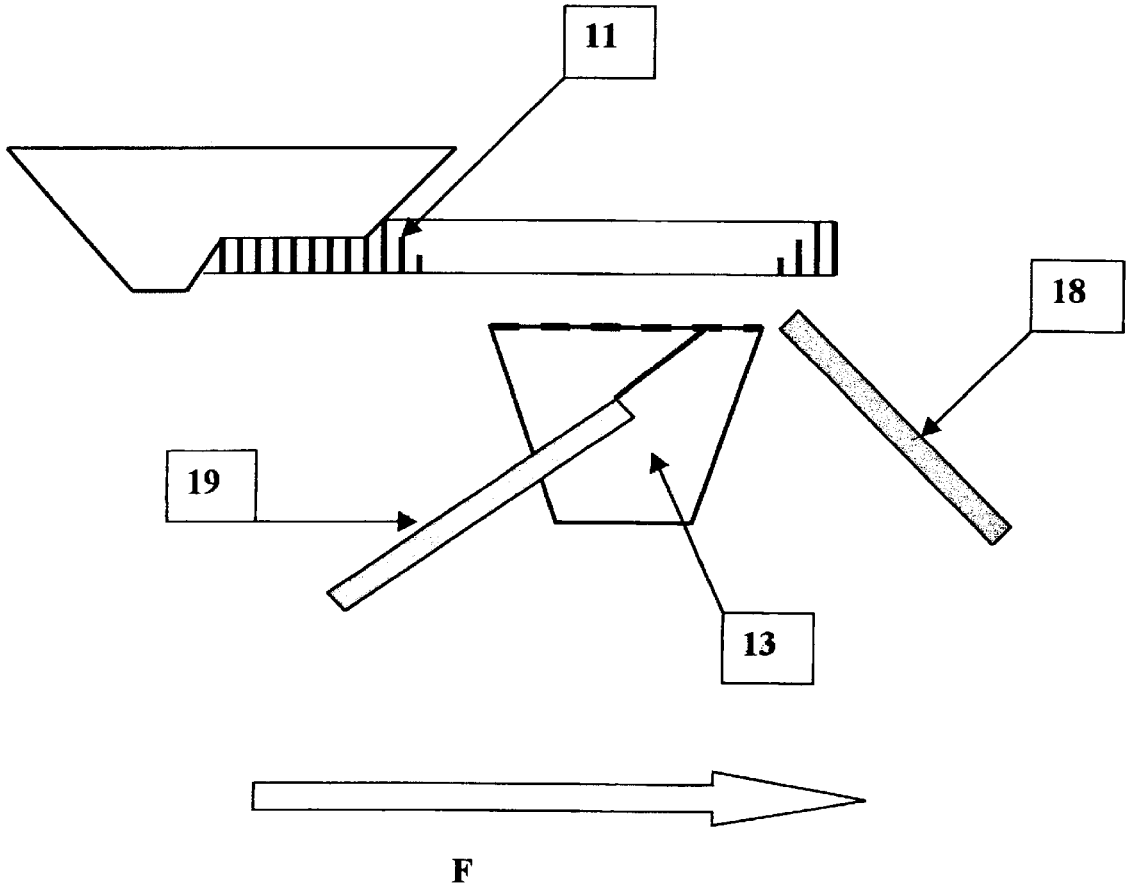
FIGS. 5 and 6 show two sequential positions of the needle and a yarn guide in relation to the yarn locking unit and the nozzle providing the air blast.
Figure 6:
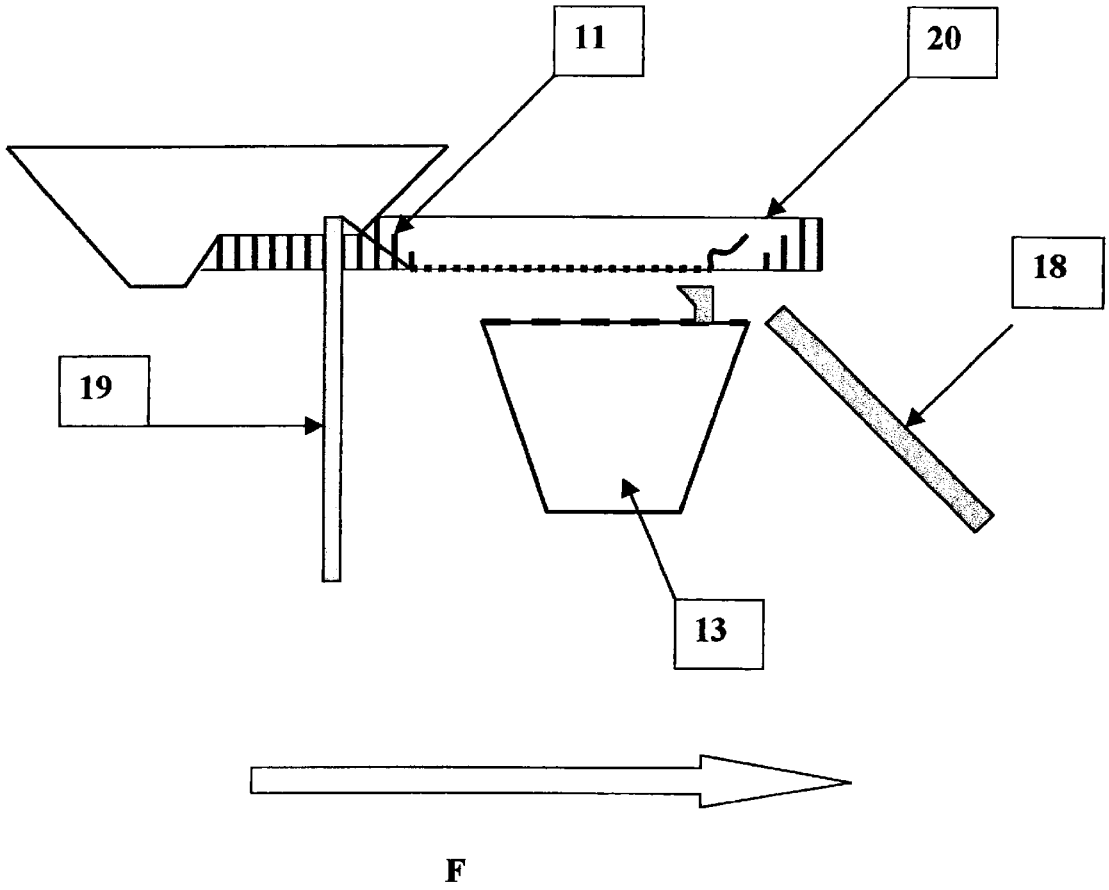

As described in connection with FIGS. 1, 3 and 4, which indicate the state of the art, FIGS. 2, 5 and 6 show (indicated using the same reference numbers but without (')), arrow F which indicates the direction of rotation of the double cylinder, needles 11, 23 in the course of their movement, sliders 12, 24 connected to the said needles, yarn cutting-and-locking unit 13, needle moving cams 14, 21, needle tongue-guard cam 15 and feed cam 16 in association with sinker cams 17, 22.

Said FIG. 2 and FIGS. 5–6 also show a nozzle 18 which is connected to a source of pressurised air and is capable of delivering a pulsed or continuous blast of air as necessary. Nozzle 18 is located in the vicinity of yarn cutting-and-locking unit 13, on the opposite side of this with respect to the position of yarn guide 19. This faces inwards towards the cylinder in such a way that the air blast catches end 20 of the yarn held in the said unit deflecting it towards the interior of the cylinder.

FIG. 5 shows (as in FIG. 3) the condition in which yarn guide 19 is not in operation and the yarn provided by it is cut and held by unit 13.

In FIG. 6 yarn guide 19 has come into operation and the action of the air blast generated by nozzle 18 on the end 20 of the yarn in yarn cutting-and-locking unit 13 can be seen.

With reference to FIG. 2 the different profile of movement cams 14 and 21, which are configured in order to bring about delayed movement of the needles so that a space is created to push the end into the cylinder through the air blast generated by nozzle 18, will also be noted.

What is claimed is:

1. Double cylinder circular knitting machine, comprising a lower cylinder part and an upper cylinder part which are coaxial and rotate together, a number of double hook needles located in grooves which coincide on the periphery of the two cylinder parts, sliders engaging the needles for selective transfer of the latter from one cylinder part to the other, cams for displacement of the sliders and through these for the rising and descending operating movements of the needles, yarn guides delivering the yarns which are to be knitted to the needles, and a fork or unit for cutting-and-locking the yarns which are excluded from the work, characterised by at least one nozzle (18) providing an air blast close to the yarn cutting-and-locking unit (13) to divert the ends of the yarns cut and held by the said unit towards the interior of the cylinder, that is towards the reverse side of the item being manufactured.

2. Double cylinder circular machine according to claim 1, in which the said nozzle (18) providing an air blast faces inwards towards the cylinder and is located adjacent to the yarn cutting-and-locking unit opposite the latter with respect to the position of the yarn guides.

3. Double cylinder circular machine according to claim 1, in which the air blast from the said nozzle (18) is pulsed or continuous.

4. Double cylinder circular machine according to claim 1, in which each cam (14, 21) moving the needles where the yarns are taken from the said yarn guides is located and configured for movement of the needles at a predetermined distance from the yarn cutting-and-locking unit to allow a space to divert the end of the cut yarn towards the interior of the cylinder.

5. Double cylinder circular machine according to claim 2, in which the air blast from the said nozzle (18) is pulsed or continuous.

6. Double cylinder circular machine according to claim 2, in which each cam (14, 21) moving the needles where the yarns are taken from the said yarn guides is located and configured for movement of the needles at a predetermined distance from the yarn cutting-and-locking unit to allow a space to divert the end of the cut yarn towards the interior of the cylinder.

7. Double cylinder circular machine according to claim 3, in which each cam (14, 21) moving the needles where the yarns are taken from the said yarn guides is located and configured for movement of the needles at a predetermined distance from the yarn cutting-and-locking unit to allow a space to divert the end of the cut yarn towards the interior of the cylinder.

* * * * *